United States Patent [19]

Zemke, Jr.

[11] 4,068,861

[45] Jan. 17, 1978

[54] LIGHTWEIGHT, FLEXIBLE SKI

[75] Inventor: Hubert R. Zemke, Jr., Danville, Calif.

[73] Assignee: Hexcel Corporation, San Francisco, Calif.

[21] Appl. No.: 661,506

[22] Filed: Feb. 26, 1976

[51] Int. Cl.[2] ..... A63C 5/04

[52] U.S. Cl. ..... 280/610; 280/608

[58] Field of Search ..... 280/610, 608

[56] References Cited

U.S. PATENT DOCUMENTS

| | | | |
|---|---|---|---|
| 3,401,949 | 9/1968 | Fouillet | 280/608 |
| 3,700,252 | 10/1972 | Schultes | 280/608 |
| 3,740,301 | 6/1973 | Manning et al. | 280/610 |
| 3,893,681 | 7/1975 | Manning et al. | 280/610 |
| 3,902,732 | 9/1975 | Fosha, Jr. et al. | 280/610 |
| 3,907,314 | 9/1975 | Tanahashi | 280/608 |

*Primary Examiner*—David M. Mitchell

[57] ABSTRACT

A lightweight ski, having excellent flexibility in both vertical and sidewall deflection, yet exhibiting high shear strength, is disclosed. The ski is fabricated using a honeycomb sandwich construction wherein the ribbon or higher shear strength direction of the honeycomb is along the length of the skis. Also, the facings bonded to the top and bottom portions of the honeycomb core comprise a fiber reinforced resin in which the fibers extending along the length of the ski to further enhance a shear strength in that direction. The sidewall of the ski comprises flexible, rubberized material and further, the ski has at least one resilient, flexible metallic running edge, the edge being so constructed that it does not substantially increase the vertical or sidewall stiffness of the ski.

1 Claim, 6 Drawing Figures

LIGHTWEIGHT, FLEXIBLE SKI

BACKGROUND OF THE INVENTION

This invention relates to snow skis and more particularly to lightweight, honeycomb laminated skis.

Skis are generally constructed by laminating various layers to a core material to form a material composite which may exhibit a wide range of structural characteristics. Wood, metal and plastic materials have been used to form ski cores onto which fiber reinforced resins may be laminated. Metal honeycomb has been found particularly suitable as a core material because of its good flexibility, high shear strength and low weight. U.S. Pat. No. 3,740,301 discloses a honeycomb core material having fiberglass resin laminates wrapped about the honeycomb core in a box configuration. Such a box configuration generally adds to the stiffness of the ski in all directions.

Further contributing to both the sidewall and the vertical stiffness of the skis are metallic edges extending along the length of the ski to form a running surface edge. Such edges are necessary not only to provide protection to the ski from wear, but also to provide a biting edge to prevent sliding on turns. One-piece metallic ski edges, however, greatly affect the vertical and sidewall flexibility of a ski. For example, a typical modulus of elasticity of a ski composite without a steel edge may have an E modulus in order of $14 \times 10^3$ psi while the same ski with a one-piece steel edge may exhibit a modulus of $36 \times 10^3$ psi. A further disadvantage of the one-piece steel edge is that where flexible skis are designed; a large amount of strain may occur under relatively low stresses, such strain being beyond the yield point of the steel edge, resulting in permanent deformation of the ski. To overcome the above disadvantages of the one-piece steel edge, and yet provide a continuous metal edge for protection and good tracking on turns, the so-called "cracked-edge" has been developed. By cracking the running surface edge, the stresses are interrupted and a greater elongation of the sections is obtained without the high stress present in a continuous steel strip which could cause permanent deformation. Such edges have been manufactured with an L cross section wherein the outer, thicker portion makes up the running surface edge while the thinner portion is inserted into the ski body and interconnects the segments of the running portion. Various segment spacings and interconnection configurations have been suggested to provide various flexural and damping characteristics. For example, in U.S. Pat. No. 3,401,949, a cracked edge is disclosed having a relatively thick arcuate interconnecting section. Such an edge provides good vertical flexibility but maintains the segmented edges in substantial alignment, thus greatly decreasing a ski's sidewall deflection which uses such an edge. U.S. Pat. No. 3,700,252 teaches variable size segments to provide different flexing and damping characteristics in various portions of the ski.

Ski designers have in the past concentrated on obtaining certain longitudinal and torsion flex characteristics and have allowed these properties to dictate the amount of sidewall deflection. Exactly how these properties affect the overall performance of a ski must be viewed in terms of the overall ski design.

The overall shape of a ski is designed to distribute the force exerted by the skier throughout the length of the ski. Thus, a ski is generally cambered with its thickest vertical portion in the middle where the skier's weight is localized. Also, the horizontal width of a ski in the middle portion is often tapered inward forming a "waist" to provide the ski with good turning characteristics. For advanced skiers, ski flexibility, especially in the sidewall direction, was never considered an important property. However, for the beginning and intermediate skier, and even for the more advanced "bump skiers" who want a relatively long ski for downhill speed yet require a ski which can go over numerous bumps and negotiate quick turns, sidewall deflection has been found to be very desirable. Previously, ski designers concentrated on longitudinal and torsional flex characteristics giving little attention to the sidewall deflection of the ski. For ski designers using wooden or plastic cores, the sidewall deflection was generally predetermined. With the use of stiff wooden cores, it is generally impossible to design a ski with any appreciable amount of sidewall deflection. Utilizing foam or plastic cores, both the top and sidewalls must be designed to increase the strength of the ski, since the core itself does not provide sufficient shear strength in any direction to permit its use without reinforcement.

It is an object of this invention to provide a lightweight, high strength ski which exhibits excellent flex characteristics in both the longitudinal and sidewall direction without loss of desired torsional properties.

SUMMARY OF THE INVENTION

This and other objects are accomplished by combining a flexible, high strength, low weight honeycomb core having its ribbon direction, which exhibits a greater shear strength and stiffness, in the longitudinal direction of the ski, with a top and bottom facing of resin, impregnated with fibers, which are substantially aligned along the longitudinal direction of the ski, thus further increasing the strength of the ski upon longitudinal flex.

Excellent sidewall deflection with adequate strength to withstand permanent deformation and fatigue is achieved by utilizing a honeycomb core, with rubberized flexible sidewalls. Further, sidewall deflection is enhanced via the use of a resilient metal strip having a cracked edge which will not significantly affect the flex characteristics of the ski in either the longitudinal or sidewall direction.

DESCRIPTION OF THE PREFERRED EMBODIMENT

Figure 1:
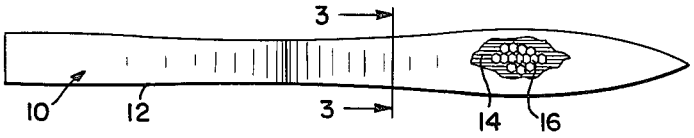
FIG. 1 is a top view of the ski in accordance with this invention.

FIG. 1 shows a top view of a ski, 10, suitable for use in this invention. The ski contours inward at the center, 12, of the ski, which is typical of ski designs. Such curvature permits good tracking on turns, insuring that the ski edge at both the heel and the toe dig into the snow during a turn, even though the skier's weight is localized in the center. Further, because of this design, sidewall deflection was not previously considered an important criteria since the ski, while tracking around a curve, would always contact the snow in the wider rear and front portions, thereby dissipating the force exerted by the skier in the middle throughout the length of the ski. However, as should be apparent, with an extremely stiff ski which exhibits no sidewall deflection, the inwardly curved center portion of the ski will only contact the snow via longitudinal flexure, thus greatly reducing the edge pressure at the center on turns. With skis exhibiting little sidewall deflection, on icy surfaces, even the advanced skier tends to slide instead of carve on turns.

FIG. 1, via the cutaway section, depicts the resin-fiber reinforced honeycomb sandwich construction of this invention, the fibers, 14, being aligned in one direction along the length of the ski. The resin-fiber layers sandwich the honeycomb, 16, on the top and bottom. Unlike many prior art skis, the sidewall should not be stiffened and may consist of a flexible material such as rubberized ABS thermo-plastic, as shown at 26 such sidewalls should exhibit a modulus of elasticity of about $2 \times 10^3$ psi. If desired, for increased torsional stiffness, a layer of fibrous material may be wrapped around the first longitudinal layers. In such a wrap, the fibers are oriented diagonally at about 45°, with the fiber direction of adjacent layers alternating so as to form a 90° angle between layers such wrapping being more fully disclosed in U.S. Pat. No. 3,740,301. Such a layer, when properly formulated and applied, increases the torsional stiffness without contributing significantly to sidewall stiffness.

Figure 2:
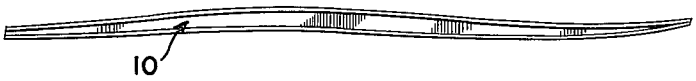
FIG. 2 is a side view of the ski.

Referring to FIG. 2, the side view of a typical ski is shown, wherein the ski running surface is cambered upward in the center area as well as being thickened in that portion of the ski. This is the most common ski design since it distributes the skier's weight throughout the length of the ski, and insures that the entire running surface contacts the snow during downhill runs. However, because of the necessity for thickening the center section of the ski, it should be apparent that when using relatively inflexible materials such as wood cores, the center portion sidewall deflection is further decreased. By utilizing a strong but lightweight honeycomb core, it is possible to provide high center section sidewall deflection which is not subject to permanent deformation over long periods of use. Thus, it is not necessary to reinforce the sides, which prevents sidewall deflection, to obtain a high strength ski.

Figure 3:
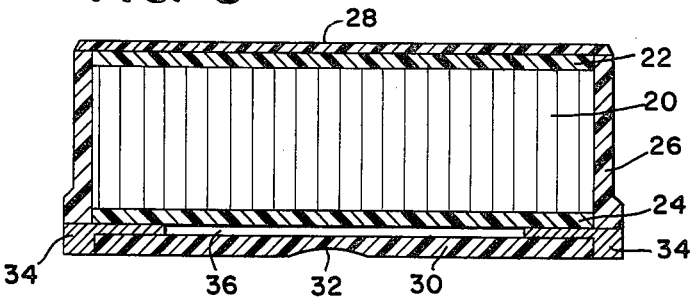
FIG. 3 is a ski, taken in cross section, along the line of 3—3 of FIG. 2.

Turning now to FIG. 3, an end view section, taken along line 3—3 of FIG. 1, is shown. The honeycomb core, 20, having its ribbon direction along the length of the ski, provides excellent resistance to shear caused by tensile and compressive flexure of the ski so as to permit a large degree of longitudinal flexing of the ski. Such resistance is further enhanced via fiber reinforced top and bottom layers, 22 and 24 respectively, in which the fibers are substantially parallel to each other along the length of the ski. Such top and bottom reinforcement contribute to good longitudinal strength, and where desired, a fiber wrap around the sides as previously discussed may be applied also to give increased tortional stiffness, i.e., less twisting of the ski. On turns, the entire ski edge along the length, will carve into the slope making the ski very desirable for beginners as well as advanced Alpine skiers. The core is encased along the side via a flexible sidewall, 26, such as a rubberized material. Top layer, 28, may be any suitable flexible, abrasion resistant material, such a polyurethane or ABS. Running surface, 30, which may have a channel groove, 32, is a flexible, low friction surface such as high density polyethylene. Metal strip, 34, is inserted into the cavity, 36, formed between the running surface and the bottom reinforcing layer, the cavity then being filled with a suitable flexible filler, such as epoxy. The top and bottom outside surfaces, as well as the sandwich layers, are selected to give good sidewall flexibility yet provide sufficient strength to the composite to withstand both longitudinal and lateral forces, so that permanent deformation or fatigue on account of the sidewall deflection will not take place.

Figure 6:
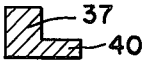
FIG. 6 is a section taken through lines 6—6 of FIG. 4.
Figure 4:
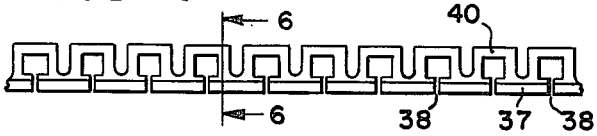
FIG. 4 is a top view of a cracked edge suitable for use in this invention.
Figure 5:
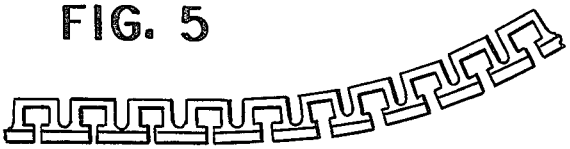
FIG. 5 depicts a cracked edge in sidewall deflection.

Referring to FIG. 4, a cracked high carbon steel edge suitable for use in this invention is shown. Steel edges are desirable because of their wear resistance as well as their ability to dig into even icy surfaces and prevent sliding of the ski. As previously discussed, continuous steel edges suffer from the disadvantage that they greatly decrease the flexibility of the ski in both the longitudinal and sidewall direction as well as exhibiting permanent deformation when stressed beyond their elastic limits. The running surface, 37, is segmented via cracks, 38, which may form segments of constant or variable length. Interconnecting sections, 40, are much thinner than running section, 37, and are inserted into cavity 36 as shown in FIG. 3. The interconnecting sections should be so constructed that they will not substantially affect the sidewall deflection, i.e., they can be readily bent as shown in FIG. 5. The interconnections themselves need little in the way of strength, since they are reinforced once they are positioned in cavity 36 by layers 24 and 30 to which they are bonded. Thus, the interconnections should be sufficiently thin and resilient to permit flexing in both the longitudinal and sidewall direction and need only be strong enough to permit handling without breaking during the manufacturing process Typically, as seen in FIG. 6, the interconnecting sections 40 are about 0.030 in. while the running sections 37 are about 0.090 in.

A ski, constructed according to this invention, exhibits longitudinal and sidewall flex substantially better than any other commercially available ski, yet exhibits sufficient torsional stiffness and overall strength to perform at high speeds.

For example, of all the skis rated by SKI magazine, published by Time Mirror Magazines, Inc., in their October 1975 issue at page 112, a ski constructed in accordance with this invention and marketed under the tradename Hexcel SUNDANCE exhibited the lowest flex index of all skis tested. In fact, it exhibited a flex index 63% less than the average of all skis tested. This is even more significant when viewed in terms of its other properties, such as its relatively high torsional stiffness of 10.5 where the average is 13.2. Also, its flex ratio of 1.08 is more uniform than the average of 1.10. Finally, it is one of the lightest skis on the market with a weight index of 4.8 compared to an average of 5.4.

I claim:

1. A lightweight, flexible ski comprising:

a honeycomb sandwich defined by an open celled core having a ribbon direction parallel to the ski length, having facings bonded to the top and bottom portion of the core, said facings being comprised of a multiplicity of substantially straight, parallel fibers extending over the length of the core, and said core having flexible sidewalls bonded directly to said core, said sidewalls comprising sheets of rubberized thermoplastic material with a modulus of about $2 \times 10^3$ psi; a running surface beneath said bottom facings and having at least one of its running edges formed from a flexible metallic strip, and said strip comprising an elongated, one-piece metal body having a plurality of laterally extending gaps transverse to its running edge to form a plurality of running edge segments, said segments having interconnecting means integral with adjacent running edge segments and said interconnecting means being less than one-half the thickness of the running edge segments whereby the ski exhibits high longitudinal and sidewall deflection.

* * * * *